US011155966B2

(12) United States Patent
Yamazaki et al.

(10) Patent No.: US 11,155,966 B2
(45) Date of Patent: Oct. 26, 2021

(54) HYDROLYTIC SHEET AND METHOD FOR MANUFACTURING HYDROLYTIC SHEET

(71) Applicant: DAIO PAPER CORPORATION, Shikokuchuo (JP)

(72) Inventors: Kosuke Yamazaki, Shikokuchuo (JP); Shinpei Mukoyama, Shikokuchuo (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 164 days.

(21) Appl. No.: 16/479,601

(22) PCT Filed: Jan. 26, 2018

(86) PCT No.: PCT/JP2018/002520

§ 371 (c)(1),
(2) Date: Jul. 21, 2019

(87) PCT Pub. No.: WO2018/143095

PCT Pub. Date: Aug. 9, 2018

(65) Prior Publication Data

US 2021/0148053 A1 May 20, 2021

(30) Foreign Application Priority Data

Jan. 31, 2017 (JP) ..... JP2017-015227

(51) Int. Cl.

| | |
|---|---|
| ***D21H 17/26*** | (2006.01) |
| ***D21H 27/00*** | (2006.01) |
| ***D21H 17/70*** | (2006.01) |
| ***D21H 23/72*** | (2006.01) |

(52) U.S. Cl.
CPC ..... *D21H 27/002* (2013.01); *D21H 17/26* (2013.01); *D21H 17/70* (2013.01); *D21H 23/72* (2013.01)

(58) Field of Classification Search
USPC ..... 162/146
See application file for complete search history.

(56) References Cited

U.S. PATENT DOCUMENTS

| | | | |
|---|---|---|---|
| 6,132,557 | A | 10/2000 | Takeuchi et al. |
| 6,749,718 | B2 | 6/2004 | Takai et al. |
| 9,399,841 | B2 | 7/2016 | Yamada |
| 9,994,726 | B2 | 6/2018 | Kimura et al. |
| 2003/0000665 | A1 | 1/2003 | Takai et al. |
| 2014/0199541 | A1 | 7/2014 | Kimura et al. |
| 2015/0315747 | A1 | 11/2015 | Heiskanen et al. |
| 2016/0355983 | A1 | 12/2016 | Yamada |
| 2019/0223680 | A1* | 7/2019 | Yamazaki ..... D21H 17/63 |

FOREIGN PATENT DOCUMENTS

| | | | |
|---|---|---|---|
| CN | 1390997 | A | 1/2003 |
| CN | 104271023 | A | 1/2015 |
| JP | H0892893 | A | 4/1996 |
| JP | H08291495 | A | 11/1996 |
| JP | 2002339218 | A | 11/2002 |
| JP | 3865506 | B2 | 1/2007 |
| JP | 2010285719 | A | 12/2010 |
| JP | 2014205924 | A | 10/2014 |
| JP | 2015121008 | A | 7/2015 |
| JP | 2016223030 | A | 12/2016 |
| JP | 2016223032 | A | 12/2016 |
| WO | 2013042653 | A1 | 3/2013 |
| WO | 2018037646 | A1 | 3/2018 |

OTHER PUBLICATIONS

JP 2010285719A, Konishi et al., Dec. 2010, machine translation.*
JP 2016 223030, Mukoyama Shimpei et al., machine translation.*
Extended European Search Report (EESR) dated May 8, 2020 issued in European Application No. 18747709.6.
International Preliminary Report on Patentability (IPRP) dated Aug. 6, 2019 (and English translation thereof) issued in International Application No. PCT/JP2018/002520.
International Search Report (ISR) dated Apr. 3, 2018 (and English translation thereof) issued International Application No. PCT/JP2018/002520.
Written Opinion of the Intemation Searching Authority (ISA) dated Apr. 3, 2018 issued in International Application No. PCT/JP2018/002520.
Chinese Office Action (and English language translation thereof) dated Jun. 3, 2021, issued in Chinese Application No. 201880008060.4.

* cited by examiner

*Primary Examiner* — Mark Halpern
(74) *Attorney, Agent, or Firm* — Maier & Maier, PLLC

(57) ABSTRACT

A hydrolytic sheet is obtained by impregnating a base paper sheet with an aqueous agent. The base paper sheet has a weight per unit area of 30 to 150 gsm and includes a water-soluble binder. The aqueous agent includes a cross-linking agent which cross-links with the water-soluble binder and cellulose nanofiber.

6 Claims, 10 Drawing Sheets

HYDROLYTIC SHEET AND METHOD FOR MANUFACTURING HYDROLYTIC SHEET

This application is a 371 of PCT/JP2018/002520 filed on 26 Jan. 2018

TECHNICAL FIELD

The present invention relates to a hydrolytic sheet impregnated with an aqueous agent in advance, such as a toilet cleaning sheet, and a method for manufacturing the hydrolytic sheet.

BACKGROUND ART

Conventionally, there has been used a dust cloth for cleaning a toilet, which is made of woven fabric and can be used repeatedly. Instead, in recent years, a disposable hydrolytic sheet made of paper is used.

This kind of hydrolytic sheet is provided with a detergent impregnated, and can be processed by being flushed down the toilet after use.

Such a hydrolytic sheet is required to have paper strength in a wet state impregnated with a detergent so as not to be torn during wiping operation, and water-disintegrability so as not to clog piping when it is flushed down the toilet or the like. For effectively achieving them, there is known a technique including usage of a hydrolytic sheet to which a water-soluble binder containing carboxymethyl cellulose (hereinafter referred to as CMC) is added as a base paper (refer to, for example, Patent Document 1).

CITATION LIST

Patent Literature

[Patent Document 1] Japanese Patent No. 3865506

SUMMARY OF INVENTION

Technical Problem

There is a demand to improve wiping property of a hydrolytic sheet in as simple a way as possible.

The present invention has been made in view of the above problem, and an object of the present invention to provide a hydrolytic sheet having improved wiping property in a simple way, and a method for manufacturing the hydrolytic sheet.

Solution to Problem

In order to solve the above-described problem, the invention of claim 1 provides a hydrolytic sheet in which a base paper sheet is impregnated with an aqueous agent, wherein the base paper sheet has a weight per unit area of 30 to 150 gsm and includes a water-soluble binder, and the aqueous agent includes a cross-linking agent which cross-links with the water-soluble binder and cellulose nanofiber.

The invention of claim 2 provides the hydrolytic sheet according to claim 1, wherein an amount of the cellulose nanofiber accumulated on a surface of the base paper sheet is larger than an amount of the cellulose nanofiber at a center in a thickness direction in the base paper sheet.

The invention of claim 3 provides a hydrolytic sheet in which a base paper sheet is impregnated with an aqueous agent, wherein the base paper sheet has a weight per unit area of 30 to 150 gsm and includes a water-soluble binder, the aqueous agent includes a cross-linking agent which cross-links with the water-soluble binder, and an amount of cellulose nanofiber accumulated on a surface of the base paper sheet is larger than an amount of the cellulose nanofiber at a center in a thickness direction in the base paper sheet.

The invention of claim 4 provides a method for manufacturing a hydrolytic sheet, the method including:

addition of a solution including a water-soluble binder to an outer surface of a base paper sheet;

drying of a sheet to which the solution has been added:

addition of an aqueous agent including a cross-linking agent which cross-links with the water-soluble binder and an aqueous agent including cellulose nanofiber to the sheet after drying.

Advantageous Effects of Invention

According to the present invention, it is possible to improve the wiping property in a simple way.

DESCRIPTION OF EMBODIMENTS

Figure 1:
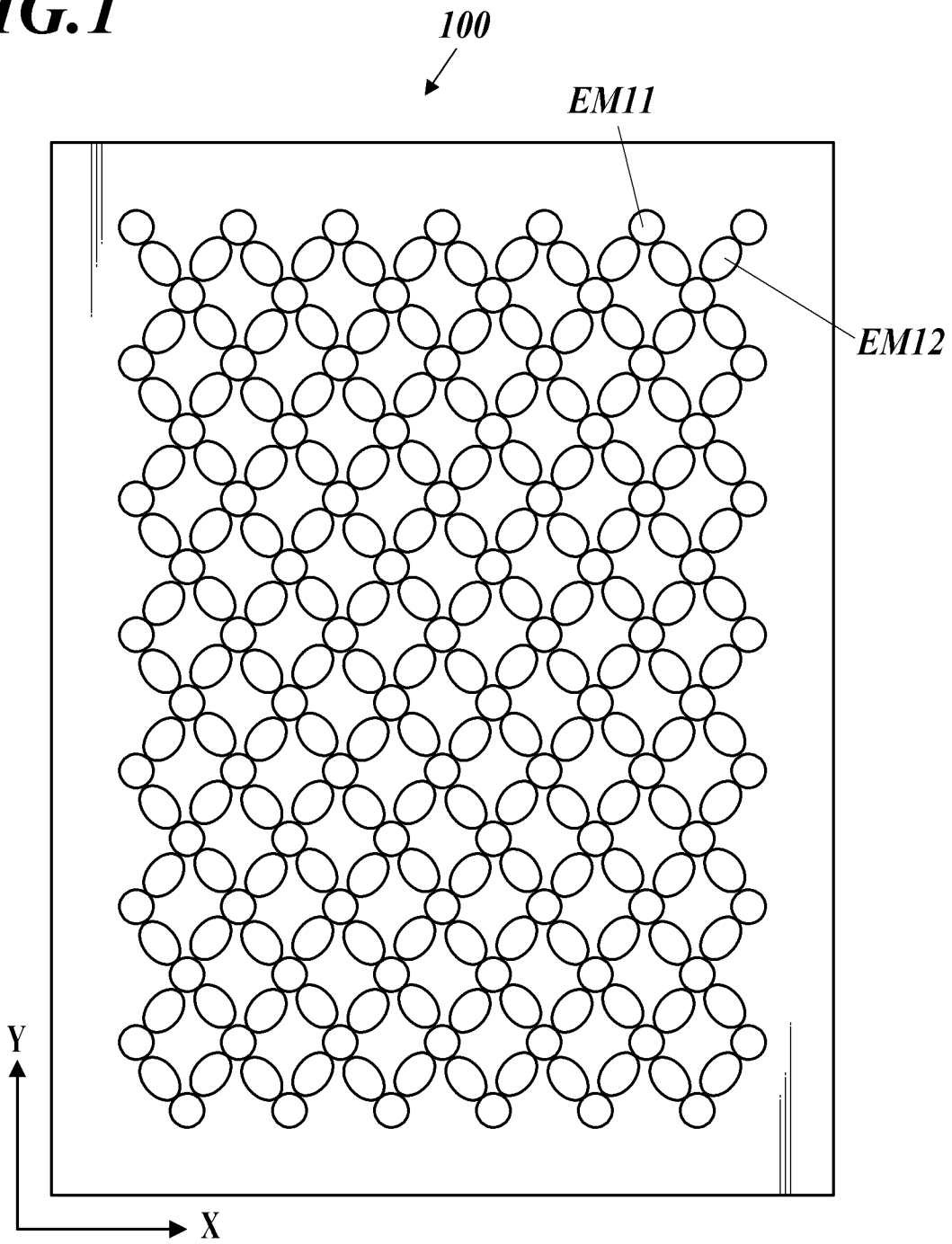
FIG. 1 is a plan view showing an example of a toilet cleaning sheet according to the present embodiment.

Hereinafter, embodiments of the hydrolytic sheet of the present invention are described in detail with reference to the drawings. However, the scope of the present invention is not limited to the illustrated examples.

The hydrolytic sheet will be described using a toilet cleaning sheet as an example, but the hydrolytic sheet also includes a wet tissue etc. impregnated with the aqueous agent for wiping other than a toilet cleaning sheet. The conveyance direction of the paper at the time of manufacturing the toilet cleaning sheet is referred to as the Y direction (length direction), and the direction orthogonal to the conveyance direction is described as the X direction (width direction).

[Description of Toilet Cleaning Sheet]

The toilet cleaning sheet 100 is formed by a ply process (lamination) of multiple (for example, two) base paper sheets and is impregnated with a predetermined aqueous agent. The base paper sheet may be formed of one base paper sheet to which the ply process has not been applied.

The weight per unit area of the base paper sheet is about 30 to 150 gsm. The weight per unit area is based on JIS P 8124.

The base paper sheet of the toilet cleaning sheet 100 is configured with a hydrolytic fiber aggregate so that it can be discarded as it is in a toilet water pool after cleaning the toilet.

The fiber aggregate is not particularly limited as long as it has water-disintegrability, but a single layer or multiple layers of paper or nonwoven fabric can be suitably used. The raw material fiber may be a natural fiber or a synthetic fiber, and they may be mixed. Suitable raw material fibers include cellulosic fibers such as wood pulp, non-wood pulp, rayon, and cotton, biodegradable fibers made of polylactic acid, and the like. In addition, with these fibers as a main component, polyethylene fibers, polypropylene fibers, polyvinyl alcohol fibers, polyester fibers, polyacrylonitrile fibers, synthetic pulp, glass wool, and the like may be used in combination.

In particular, a fiber aggregate containing at least pulp is preferable, and suitable pulp used as a raw material includes leaf bleached kraft pulp (LBKP) and needle bleached kraft pulp (NBKP) blended at an appropriate ratio.

More preferably, a blending ratio of the leaf bleached kraft pulp exceeds 50% by weight. In other words, the blending ratio of the needle bleached kraft pulp to the leaf bleached kraft pulp is less than 1/1. As the blending ratio of the leaf bleached kraft pulp to the needle bleached kraft pulp is increased, gaps between fibers are reduced and moisture transpiration is suppressed. Therefore, it is possible to improve difficulty of drying.

Further, it may be configured of a sheet made of crushed pulp or a sheet of crushed pulp covered or sandwiched with hydrolytic paper.

A water-soluble binder for enhancing paper strength is added to the base paper sheet of the toilet cleaning sheet 100. Examples of the water-soluble binder include a binder component such as carboxymethyl cellulose, polyvinyl alcohol, starch or a derivative thereof, hydroxypropyl cellulose, sodium alginate, trant gum, guar gum, xanthan gum, gum arabic, carrageenan, galactomannan, gelatin, casein, albumin, purplan, polyethylene oxide, Viscose, polyvinyl ethyl ether, sodium polyacrylate, sodium polymethacrylate, polyacrylamide, hydroxylated derivatives of polyacrylic acid, polyvinyl pyrrolidone/vinyl pyrrolidone vinyl acetate copolymer, and the like.

In particular, from the viewpoint of good water-disintegrability and wet strength developed by cross-linking reaction, a water-soluble binder having a carboxyl group is preferably used.

The water-soluble binder having a carboxyl group is an anionic water-soluble binder which readily generates carboxylate in water. Examples thereof include polysaccharide derivatives, synthetic polymers, and natural products.

Examples of the polysaccharide derivative include a salt of carboxymethyl cellulose, carboxyethyl cellulose or a salt thereof, and carboxymethylated starch or a salt thereof, and an alkali metal salt of carboxymethyl cellulose (CMC) is particularly preferable.

CMC desirably has an etherification degree of 0.6 to 2.0, particularly 0.9 to 1.8, more preferably 1.0 to 1.5. It is because water-disintegrability and wet paper strength are excellently developed.

A water-swellable CMC is preferably used. This forms cross-links with a specific metal ion as the cross-linking agent in the aqueous agent and exerts a function of linking the fibers constituting the sheet while remaining unswollen. As a result, strength as a wiping sheet resistant to cleaning and wiping is exhibited.

In the case of the toilet cleaning sheet 100 of the present embodiment, CMC is added as the water-soluble binder.

Examples of the synthetic polymers include a salt of a polymer or a copolymer of an unsaturated carboxylic acid, a salt of a copolymer of an unsaturated carboxylic acid and a monomer copolymerizable with the unsaturated carboxylic acid, and the like. Examples of the unsaturated carboxylic acid include an acrylic acid, methacrylic acid, itaconic acid, crotonic acid, maleic anhydride, maleic acid, fumaric acid, and the like. Examples of the monomer copolymerizable with them include an ester of the unsaturated carboxylic acid, vinyl acetate, ethylene, acrylamide, vinyl ether, and the like. A particularly preferred synthetic polymer is one using acrylic acid or methacrylic acid as the unsaturated carboxylic acid, and specifically include salts of polyacrylic acid, polymethacrylic acid, or acrylic acid methacrylic acid copolymer, and salts of a copolymer of acrylic acid or methacrylic acid, an alkyl acrylate or alkyl methacrylate. Examples of natural products include sodium alginate, xanthan gum, gellan gum, tarraganth gum, pectin, and the like.

Such a toilet cleaning sheet 100 may be impregnated with CMC uniformly in the thickness direction of the base paper sheet. But preferably, the content of CMC in the base paper sheet gradually increases from the center toward the front and back surfaces in the thickness direction. It is because the toilet cleaning sheet 100 is less likely to be torn than the conventional products uniformly impregnated with the water-soluble binder in the same amount, even if it is used for rubbing the rim of a toilet bowl strongly.

The ratio (length/width) of fiber orientation in the length and width directions of the toilet cleaning sheet 100 is not particularly limited, but it is preferably 0.8 to 2.0, more preferably 0.8 to 1.2.

Figure 2A:
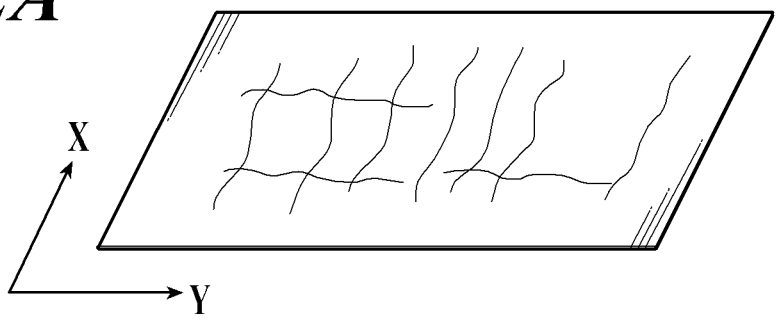
FIG. 2A is a view showing fiber orientation of a conventional sheet.
Figure 2B:
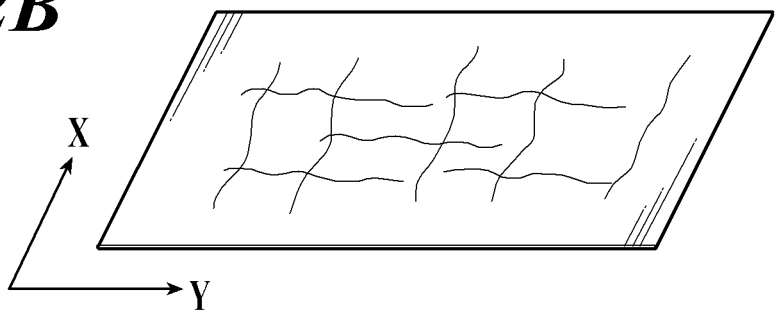
FIG. 2B is a view showing fiber orientation according to the present invention.

In the papermaking step which is a step for manufacture paper, as fibers are spread over wire(s) of a papermaking machine and flows in the transport direction, many fibers on the paper are generally aligned in the length direction, which is the conveyance direction by the papermaking machine (for example, length:width=2.3:1; see FIG. 2A). Therefore, the fiber density in the width direction is low such that the fibers easily break. That is, the sheet is easily torn depending on the wiping direction. Therefore, in the present embodiment, as shown in FIG. 2B, the fiber orientation ratio in the length and width directions of the toilet cleaning sheet 100 is set to be 0.8 to 2.0, preferably 0.8 to 1.2. As a result, it is possible to provide the toilet cleaning sheet 100 which is not easily torn even by wiping with the sheet in any direction. The fiber orientation ratio in the length and width directions can be obtained from the ratio of a wet strength in the MD direction to that in the CD direction.

The toilet cleaning sheet 100 of the present embodiment is impregnated with a predetermined aqueous agent containing the cross-linking agent for cross linking of the water-soluble binder (CMC in the toilet cleaning sheet 100 of the present embodiment), and cellulose nanofiber (hereinafter referred to as CNF). The aqueous agent contains, in addition to the cross-linking agent and CNF, auxiliary agents such as an aqueous detergent, a fragrance, an antiseptic, a disinfectant, an organic solvent, and the like.

The base paper sheet is impregnated with the aqueous agent, after it is impregnated with the water-soluble binder and dried.

The aqueous agent for impregnation is 100 to 500% by weight relative to the weight of the base paper sheet as the base material of the toilet cleaning sheet 100, preferably 150 to 300% by weight.

As the cross-linking agent, boric acid, various metal ions and the like can be used, but a polyvalent metal ion is preferably used when CMC is used as the water-soluble binder. In particular, preferably used is one or more of polyvalent metal ions selected from the group consisting of alkaline earth metals, manganese, zinc, cobalt, and nickel, from the viewpoint of developing wet strength for durability in use by sufficiently bonding the fibers and from the viewpoint of improving water-disintegrability sufficiently. Among these metal ions, ions of calcium, strontium, barium, zinc, cobalt, or nickel are used particularly preferably.

Here, CNF refers to fine cellulose fibers obtained by fibrillating pulp fibers. In general, CNF refers to cellulose fibers containing cellulose fine fibers having a fiber width of nano-order size (at least 1 nm and at most 1000 nm). An average fiber width is preferably at most 100 nm. Number average, median, mode diameter (mode) and the like are calculated from a certain number of fibers and used as the average fiber width.

Examples of pulp fibers usable for manufacturing CNF include chemical pulp such as broad leaf tree pulp (LBKP) and needle leaf tree pulp (NBKP); mechanical pulp such as Bleaching thermomechanical pulp (BTMP), stone ground pulp (SGP), pressurized stone ground pulp (PGW), refiner ground pulp (RGP), chemi-ground pulp (CGP), thermogrand pulp (TGP), grand pulp (GP), thermomechanical pulp (TMP), chemi-Thermo Mechanical pulp (CTMP), and refiner mechanical pulp (RMP); used paper pulp manufactured from tea waste paper, craft envelope waste paper, magazine waste paper, newspaper waste paper, leaflets waste paper, office waste paper, cardboard waste paper, high quality white waste paper, Kent waste paper, simili waste paper, regional waste paper, and groundwood paper; and deinked pulp (DIP) made by deinking used paper pulp. As long as the effects of the present invention are not impaired, these may be used alone or in combination of multiple kinds. Further, chemical treatment such as carboxymethylation may be applied to the pulp fibers before use.

Methods for manufacturing CNF are not limited to, but include mechanical methods such as a high pressure homogenizer method, a microfluidizer method, a grinder grinding method, a bead mill freeze pulverization method, and an ultrasonic fibrillating method. In addition, manufacture of nanofiber is promoted by using TEMPO oxidation treatment, phosphoric acid esterification treatment, acid treatment, etc. in combination.

The amount of CNF (blending ratio) in the aqueous agent is preferably 0.0002 to 0.0004%. For example, the CNF aqueous solution at a concentration of 2% is prepared and the ratio of the CNF aqueous solution is set to 0.01 to 0.02% in the aqueous agent. As a result, the amount of CNF (blending ratio) in the aqueous agent is in the above amount.

As the aqueous detergent in addition to a surfactant, lower or higher (aliphatic) alcohol may be used, for example.

As the fragrance, for example, one or several kinds of oily fragrance such as orange oil, in addition to an aqueous fragrance, may be appropriately selected and used.

As the antiseptic, for example, parabens such as methylparaben, ethylparaben, propylparaben, and the like may be used. As the disinfecting agent, for example, benzalkonium chloride, chlorhexidine gluconate, povidone iodine, ethanol, benzyl cetyl oxide, triclosan, chloroxylenol, isopropylmethylphenol, and the like may be used. As the organic solvent, polyhydric alcohols such as glycol (divalent), glycerin (trivalent), sorbitol (tetravalent), and the like may be used.

Further, the auxiliary agent of the above-mentioned components of the aqueous agent may be selected appropriately, and a component which fulfills other functions may be contained in the aqueous agent as necessary.

In this way, the base paper sheet into which the water-soluble binder is blended is impregnated with the aqueous agent containing the cross-linking agent which cross-links with the water-soluble binder and CNF after being dried. The surface of the base paper sheet is reformed by application and drying of the water-soluble binder, and then the aqueous agent containing CNF is applied to the base paper sheet. As a result, CNF is less likely to be introduced into the base sheet when the aqueous agent is applied thereto. Thus, CNF is accumulated on the surface more than at the center in the thickness direction of the base paper sheet and surface solidity increases without a large amount of CNF. As a result, the wiping property of the toilet cleaning sheet 100 can be improved effectively.

The surface of the toilet cleaning sheet 100 may be the paper sheet as it is, but is preferably embossed. In the case of the toilet cleaning sheet 100, for example, two kinds of embosses EM11 and EM12 are made thereon, as shown in FIG. 1.

Although the shape, number, area ratio, etc. of the embosses are arbitrary, in the case of the toilet cleaning sheet 100, the embosses EM11 are arranged to forma diamond lattice. As a result, unevenness of wiping can be reduced as compared with the case where the embosses EM11 are arranged to form a square lattice or a rectangular lattice. The embosses EM12 are arranged between the embosses EM11.

Figure 3A:
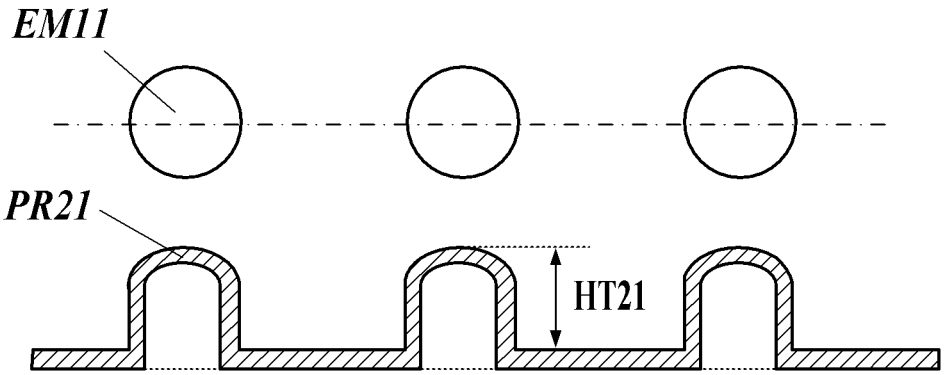
FIG. 3A is an enlarged view and a sectional view of emboss portions of the toilet cleaning sheet.

Each of the embosses EM11 has, as shown in FIG. 3A, a protrusion PR21 having a curved shape.

Figure 3B:
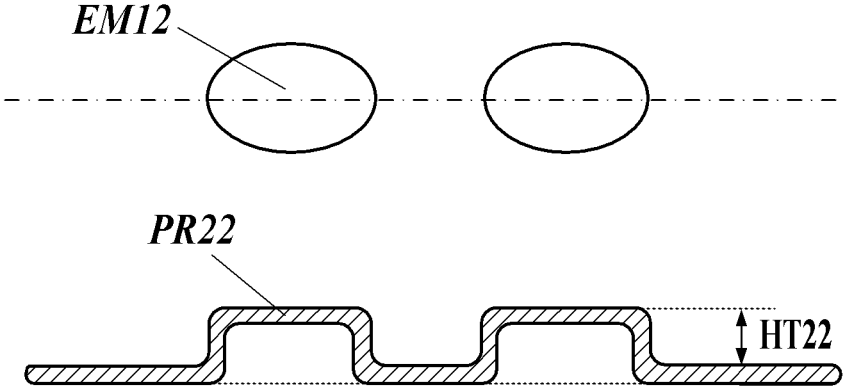
FIG. 3B is an enlarged view and a sectional view of emboss portions of the toilet cleaning sheet.

Each of the embosses EM12 has, as shown in FIG. 3B, a protrusion PR22 having a plane shape.

Figure 3C:
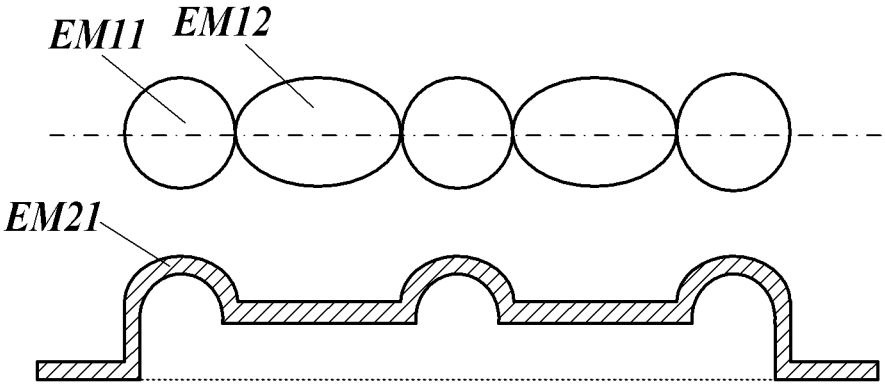
FIG. 3C is an enlarged view and a sectional view of emboss portions of the toilet cleaning sheet.

Since the embosses EM12 are each arranged between the embosses EM11, the protrusions PR21 of the embosses EM11 and the protrusions PR22 of the embosses EM12 closely adheres to each other to form a continuous emboss EM21 as shown in FIG. 3C.

Alternatively, the protrusions PR21 of the embosses EM11 and the protrusions PR22 of the embosses EM12 do not have to be continuous but may be merely close to each other.

By forming the two kinds of embosses EM11 and EM12 in this way, it is possible to increase contact areas with the object to be cleaned. As a result, the toilet cleaning sheet 100 becomes less stiff and has higher wiping property.

That is, as a result of forming the embosses EM11 with the protrusion PR21 having a curved surface and the embosses EM12 with the protrusion PR22 having a plane surface on the entire sheet surface of the toilet cleaning sheet 100, the respective embosses are deformed for the first time when a force is applied to the toilet cleaning sheet 100 during the wiping operation so that the contact areas increase. Therefore, it is possible to improve flexibility due to deformation of the respective embosses, as well as to increase the contact areas.

Figure 4A:
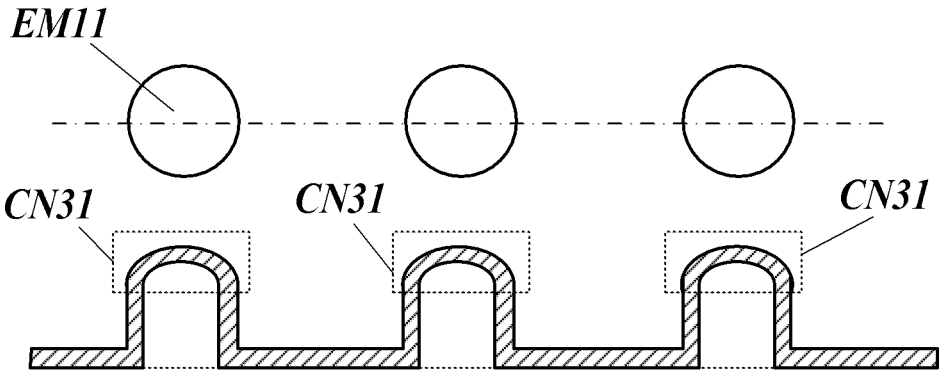
FIG. 4A is an explanatory view showing an example of a contact area of the embosses.
Figure 4B:
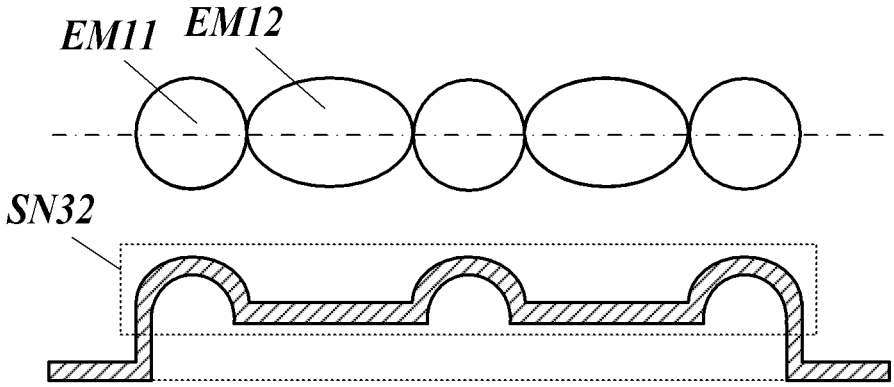
FIG. 4B is an explanatory view showing an example of a contact area of the embosses.

For example, if there is a single kind of embosses EM11, the contact areas CN31 are formed discretely in the vicinity of the respective embosses EM11 after deformation of the embosses EM11 due to the force applied to the toilet cleaning sheet 100 during the wiping operation, as shown in FIG. 4A. On the other hand, if there are two kinds of embosses EM11 and EM12 in combination, as compared with the contact area CN31 of FIG. 4A, the contact areas SN32 become large after deformation of the embosses EM11 and EM12 due to the force applied to the toilet cleaning sheet 100 during the wiping operation as shown in FIG. 4B.

Further, the two kinds of embosses EM11 and EM12 also exhibit the effect of ordinary embosses, such as improvement of texture, absorbency, bulkiness, etc. of the toilet cleaning sheet. Furthermore, the continuous embosses EM21 also exhibit the effect of good appearance by embossing, as well as ordinary embosses.

The toilet cleaning sheet 100 is folded in two by a fold process at the center portion in the Y direction. Then, it is stored in a plastic case for storage or in a packaging film in a folded state, and unfolded as necessary at the time of use. The folding of the toilet cleaning sheet 100 is not limited to folding in two, but may be folding in four or eight, for example.

[Method for Manufacturing Toilet Cleaning Sheet]

Figure 5:
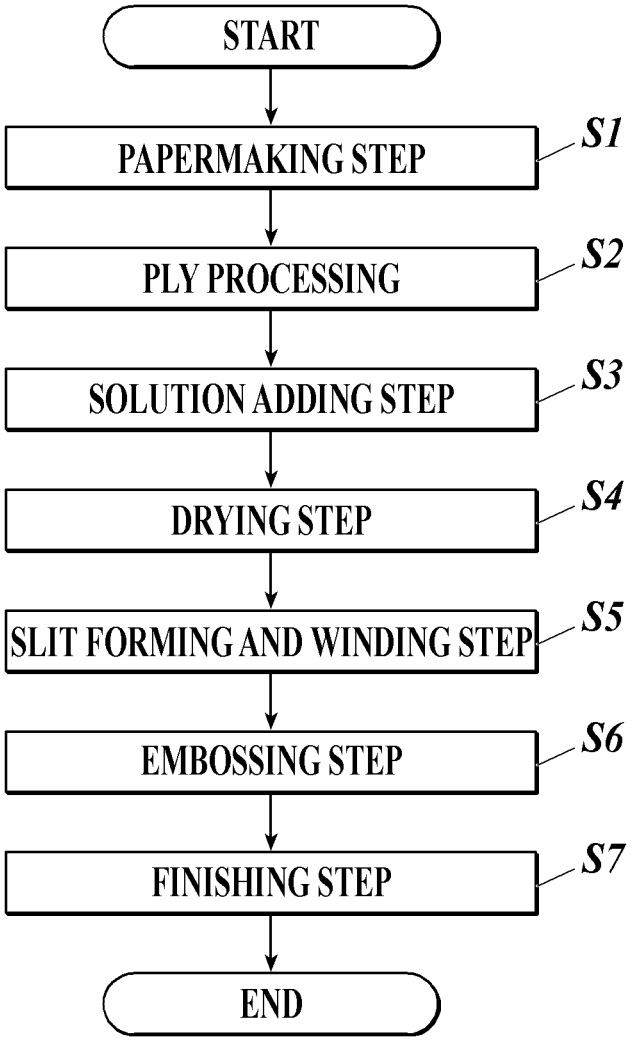
FIG. 5 is a flowchart showing a method for manufacturing the toilet cleaning sheet according to the present embodiment.
Figure 6:
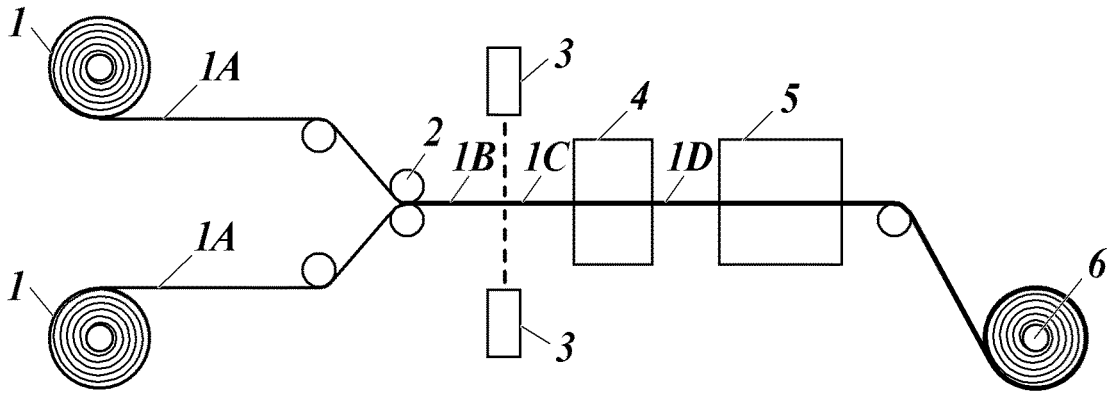
FIG. 6 is a schematic view of equipment (solution addition equipment) for manufacturing the toilet cleaning sheet according to the present embodiment.
Figure 7:
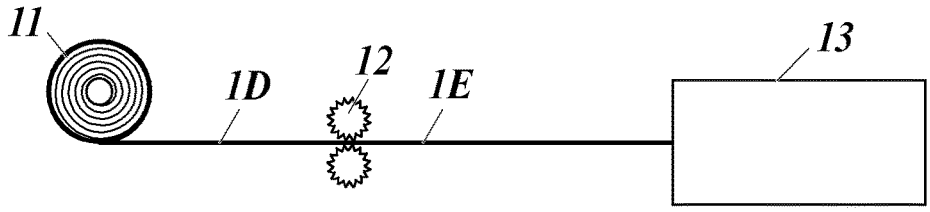
FIG. 7 is a schematic view of equipment (processing equipment) for manufacturing the toilet cleaning sheet according to the present embodiment.

Next, a method for manufacturing the toilet cleaning sheet will be described. FIG. 5 is a flowchart showing a method for manufacturing the toilet cleaning sheet. FIG. 6 is a schematic diagram of solution adding equipment for adding a water-soluble binder solution to the base paper sheet (paper sheet) of the toilet cleaning sheet. FIG. 7 is a schematic view of processing equipment for processing the base paper sheet to which the water-soluble binder solution has been added in the solution adding equipment shown in FIG. 6.

In the method for manufacturing the toilet cleaning sheet, as shown in FIG. 5, first, a papermaking step (S1) of making a paper to be a base paper (not shown) is performed with a papermaking machine.

Next, as shown in FIGS. 5 and 6, in the solution addition equipment, the ply processing step (S2) of making a ply continuous sheet 1B by the ply process of the continuous dry base paper 1A, 1A which are respectively drawn out from multiple (for example, two) primary web roll 1, 1 on which the base paper is wound up after papermaking; a solution adding step (S3) of adding the water-soluble binder solution to the ply continuous sheet 1B to form a continuous sheet 1C; a drying step (S4) of drying the continuous sheet 1C; and a slit-forming and winding step (S5) of forming a slit and winding the dried continuous hydrolytic sheet 1D are performed. Although the number of primary web rolls can be appropriately changed as long as it is two or more, in the following descriptions, an example of using two primary web rolls will be described.

Next, as shown in FIGS. 5 and 7, in the processing equipment, an embossing step (S6) of embossing the continuous hydrolytic sheet 1D drawn out from the secondary web roll 11 after winding in the slit-forming and winding step (S5), and a finishing step (S7) of applying a finish process to the embossed sheet 1E on which embossing has been performed.

Details of each step is described below.

[Papermaking Step]

First, the papermaking step (S1) according to the present embodiment will be described. In the papermaking step (S1) of the present invention, for example, the base paper sheet is formed by making a papermaking raw material by a known wet papermaking technique. That is, after making the papermaking raw material in a state of wet paper, it is dried with a dryer or the like to form the base paper sheet such as thin paper or crepe paper.

Besides pulp and a coagulant, papermaking chemicals such as wet paper strength agent, adhesive, release agent and the like may be appropriately used in the base paper sheet.

In addition, although the water-soluble binder solution is added in a solution addition step in the solution addition equipment described later in the embodiment of the present invention, the water-soluble binder solution may be added in the papermaking step.

If the water-soluble binder solution is also added in the papermaking step, it is possible to obtain a hydrolytic sheet having large total strength. Then, by further adding the water-soluble binder solution in the subsequent step of the solution adding step, the surface strength of the hydrolytic sheet can be further increased.

As a method of adding the water-soluble binder solution in a papermaking step, for example, a method of wet papermaking using a raw material in which the water-soluble binder and a fixing agent to fix the water-soluble binder to the pulp fibers are added to a dispersion containing pulp as a papermaking raw material (Japanese Unexamined Patent Publication No. hei3-193996). That is, the water-soluble binder is internally adding in the method. It is also possible to perform wet papermaking of a sheet from a dispersion containing pulp, to spray and dry or to coat and dry the water-soluble binder after press dewatering or semi-drying, and to manufacture a fiber sheet containing a predetermined amount of the water-soluble binder. That is, the water-soluble binder is externally added in the method. In this case, it is possible to obtain a fiber sheet with a lower density and better water-disintegrability by using a pre-drying system such as a hot air passage dryer rather than press dewatering. Furthermore, instead of the wet papermaking method described above, it is also possible to manufacture a fiber sheet by fibrillating the dry pulp fibers without using water, forming a web, spraying the water-soluble binder, and then drying. It is a so-called air laid manufacturing method.

Figure 8:
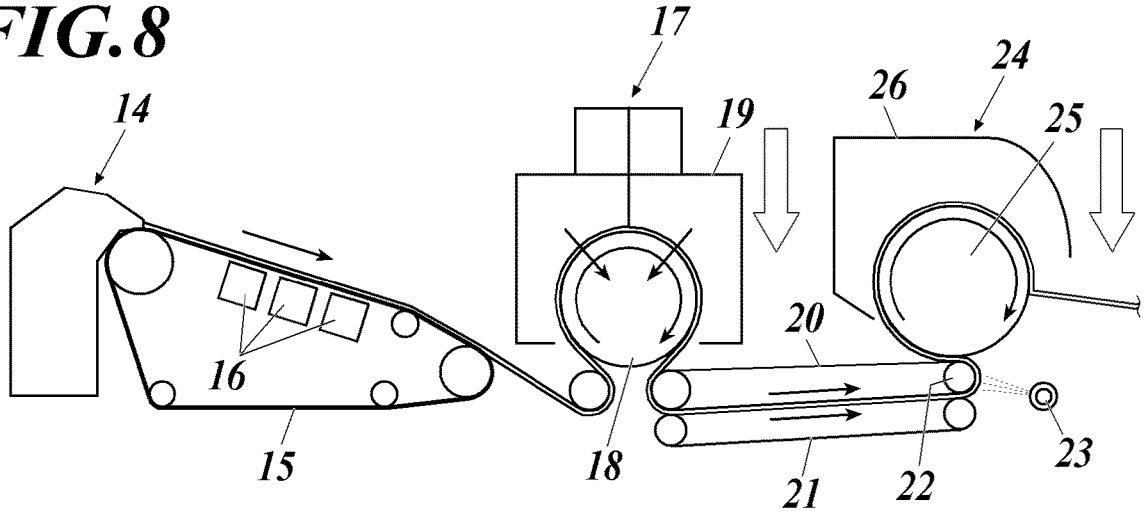
FIG. 8 is a schematic view showing an example of a papermaking machine.

FIG. 8 shows a schematic diagram of an example of a manufacturing apparatus preferably used for manufacturing a fiber sheet where the water-soluble binder is used as a binder. The manufacturing apparatus (wet papermaking machine) shown in FIG. 8 is provided with a former 14, a wire part, a first dry part 17, a spray part, and a second dry part 24.

The former 14 adjusts the finished paper material supplied from a preparation device (not shown) to a predetermined concentration and then supplies it to the wire part. The preparation device (not shown) is provided with a device for separating and pulverizing raw materials such as pulp fibers and an adding device for adding additives such as a sizing agent, a pigment, a paper strengthening agent, a bleaching agent, a coagulant and the like to the separated and pulverized raw material, and is configured to prepare the paper material including a raw material at a predetermined concentration according to the features of hydrolytic paper as a finished paper material. It is also possible to mix a binder in pulp slurry. In the wire part, wet paper is formed from the finished paper material supplied from the former in a paper making net. In the first dry part 17, the wet paper formed in the wire part is dried. In the spray part, the binder is sprayed onto the paper dried in the first dry part 17. In the second dry part 24, the paper in wet condition with the binder sprayed at the spray part is dried.

The finished paper material supplied from the former 14 is subjected to papermaking at the wire part, and wet paper is formed on the wire 15. Moisture in the wet paper is removed by suction by a suction box 16 installed at the wire part, so that the wet paper has a predetermined moisture content. The wet paper is then introduced into the first dry part 17 and dried. The first dry part 17 is configured with a through air dryer (hereinafter referred to as TAD). The TAD includes a rotating drum 18 whose circumferential surface is air permeable, and a hood 19 which covers the rotating drum 18 substantially airtightly. In the TAD, air heated to a predetermined temperature is supplied into the hood 19. The heated air flows from the outside to the inside of the rotating drum 18. The wet paper is conveyed while being held on the circumferential surface of the rotating drum 18 rotating in the arrow direction in FIG. 8. While being conveyed through the TAD, the heated air penetrates the wet paper in the thickness direction thereof, whereby the wet paper is dried and becomes paper.

At the spray part, an aqueous solution including a binder (water-soluble binder solution) is sprayed on the paper obtained at the first dry part 17. The spray part is at a position between the first and second dry parts 17, 24. Both dry parts 17, 24 are connected via a conveyor.

The conveyor is provided with an upper conveyor belt 20 and a lower conveyor belt 21 each rotating in the arrow direction. The conveyor 20 is configured to convey the paper dried by the TAD of the first dry part 17 to the second dry part 24 in a state of being sandwiched between these belts 20, 21. A vacuum roll 22 is arranged at a folding back end on the downstream side of the upper conveyor belt 20. The vacuum roll 22 attracts paper on the back surface of the upper conveyor belt 20, and conveys the upper conveyor belt 20 under the attracting state.

As shown in FIG. 8, the spray part is provided with a spray nozzle 23. The spray nozzle 23 is arranged below the second dry part 24, facing the vacuum roll 22. The spray nozzle 23 sprays a spray liquid including the binder toward the vacuum roll 22 and adds (externally adds) the spraying liquid to the paper.

After the binder is supplied at the spray part, the paper is conveyed to the second dry part 24. The second dry part 24 is configured with a Yankee dryer. The paper in a wet state by spraying the spraying liquid is conveyed while being held on the circumferential surface of the rotating drum 25 of the Yankee dryer installed in the hood 26. The paper becomes dry while it is held and conveyed by the rotating drum 25.

The binder is supplied at the spray part at a position between the first and second dry parts 17 and 24. For example, the binder may be sprayed from above the upper conveyor belt 20 (the position indicated by the arrow between the first and second dry parts 17 and 24 shown in FIG. 8). Further, the binder may be sprayed from the upper side of the paper dried at the second dry part 24 (the position indicated by the arrow on the right side of the second dry part 24 shown in FIG. 8). Between the first and second dry parts 17, 24 and after the second dry part 24, the binder may be sprayed not only from the upper side but also from the lower side or from both the upper and lower sides.

In the present embodiment, in the papermaking step, the fiber orientation ratio in the length and width directions (length/width) of the base paper sheet is adjusted to 0.8 to 2.0, preferably 0.8 to 1.2. The fiber orientation can be adjusted in the papermaking machine, for example, by adjusting the angle at which the papermaking raw material is supplied to the wire part. The angle at which the papermaking raw material is supplied may be adjusted, for example, by adjusting the slice opening degree of the head box. Alternatively, the fiber orientation may be adjusted by giving vibration in a direction orthogonal to the conveyance direction (running direction) of the papermaking machine.

[Ply Processing Step]

Next, the ply processing step (S2) of the present embodiment will be described. In the ply processing step (S2), as shown in FIG. 6, the continuous dry base paper 1A, 1A each continuously drawn out from the web roll 1 is supplied to an overlapping unit 2 for the ply process along the continuous direction to form a ply continuous sheet 1B. The overlapping unit 2 is configured with a pair of rolls, performs the ply process of each continuous dry base paper 1A, 1A to form a ply continuous sheet 1B to which the ply process has been applied. When overlapping the continuous dry base paper 1A, 1A, it may be weakly fastened with pin embosses (contact embosses) so that the continuous dry base paper 1A, 1A is not easily displaced.

[Solution Adding Step]

Next, the solution adding step (S3) of the present embodiment will be described. In the solution adding step (S3), as shown in FIG. 6, the water-soluble binder solution is sprayed on both outer surfaces (the surface of the continuous dry base paper 1A, 1A which does not face the continuous dry base paper 1A, 1A after the ply process) of the ply continuous sheet (paper sheet) 1B by each of the two-fluid type spray nozzles 3, 3 to manufacture a continuous sheet 1C.

The water-soluble binder solution contains carboxyl methyl cellulose (CMC) as the water-soluble binder.

As a method of spraying the water-soluble binder solution, the water-soluble binder solution described above may be sprayed onto one of the outer surface of the ply continuous sheet 1B. A sheet equivalent to the continuous sheet 1C described above may be generated by spraying the above water-soluble binder solution from a two-fluid type spray nozzle on the outer surface (the surface of the sheet which does not face another sheet) of at least one of the continuous dry base paper 1A, 1A respectively drawn out from the above-described primary web rolls 1, 1, and immediately after that, by applying the ply process to the continuous dry base paper 1A, 1A.

The two-fluid type spray nozzle 3 is a spray nozzle for mixing and spraying compressed air and liquid divided into two systems. As compared with the one-fluid type spray nozzle from which sprays the compressed liquid alone, it is possible to spray the liquid finely and uniformly.

In the present embodiment, the nozzle diameter of the spray nozzle 3 is at most 0.09 gal/min. In addition, preferred spraying conditions of the present embodiment include the concentration of the water-soluble binder solution of 3.0 to 4.0%, the discharge temperature of 50 to 70° C., the liquid pressure of 2 MPa or more, and the air pressure of 0.05 to 0.2 MPs.

By spraying the water-soluble binder solution onto the outer surface of the ply continuous sheet 1B in this way, the content of CMC in the toilet cleaning sheet gradually increases from the inside to the outside in the thickness direction. Therefore, it is possible to improve the surface strength while securing water-disintegrability, and to manufacture a toilet cleaning sheet with less damages even against strong rubbing.

The inside and outside in the thickness direction are determined as follows. In the case of application to both surfaces, the center part in the thickness direction is determined as the inside and the outer surface is determined as the outside. In the case of application to one surface, the surface to which the binder solution is not applied is determined as the inside, and the surface to which the binder solution is applied is determined as the outside.

[Drying Step]

Next, the drying step (S4) of the present embodiment will be described. In the drying step (S4), as shown in FIG. 6, the insoluble liquid in the water-soluble binder solution of the continuous sheet 1C evaporates in the drying equipment 4, so that the effective ingredient, in particular CMC, is fixed to the fibers.

Here, since the amount of impregnated water-soluble binder solution decreases from the outside toward the inside in the thickness direction of the continuous sheet 1C, the CMC fixing amount decreases toward the inner side in the thickness direction. Therefore, in impregnation with the aqueous agent in the finishing step (S7) described later, the cross-linking reaction does not likely to occur and the number of gaps increases at the inner side in the thickness direction. As a result, the aqueous agent can be confined in the sheet. Therefore, the obtained toilet cleaning sheet is difficult to dry.

As the drying equipment 4, dryer equipment with a hood for blowing hot air against the continuous sheet 1C and drying it can be used. For more tight adhesion to each other, a press roll or a turn roll may be installed and the continuous sheet 1C may be passed through the press roll or the turn roll before the drying step (S4).

The drying equipment may be infra-red irradiation equipment. In this case, multiple infrared ray irradiation units are arranged in parallel in the conveyance direction of the continuous sheet 1C, and the continuous sheet 1C to be conveyed is irradiated with infrared rays and becomes dry. Since moisture is heated by the infrared rays and dried, it is can be uniformly dried compared with a dryer with hot air, and the occurrence of wrinkles in the slit-forming and winding step is prevented in the subsequent stage.

[Slit-Forming and Winding Step]

Next, the slit-forming and winding step (S5) of the present embodiment will be described. In the slit-forming and winding step (S5), in order to prepare a web to be processed with an off-line processing machine from a continuous hydrolytic sheet 1D to which the ply process has been applied, the continuous hydrolytic sheet 1D dried in the drying step (S4) and to which CMC has been fixed is subjected to slit-formation at a predetermined width with a slitter 5 while adjusting the tension, and is wound in winder equipment 6. The winding speed is determined as appropriate considering the ply processing step (S2), solution adding step (S3) and drying step (S4). It should be noted that the sheet breaks if the winding speed is too rapid, and wrinkles will occur if it is too slow.

By crimping the continuous hydrolytic sheet 1D to which the ply process has been applied in the slit-forming and winding step (S5), the continuous hydrolytic sheet 1D is further integrated so as to be substantially one sheet.

[Embossing Step]

Next, the embossing step (S6) of the present embodiment will be described. In the embossing step (S6), as shown in FIG. 7, the continuous hydrolytic sheet 1D drawn out from the secondary web roll 11 is subjected to embossing for forming a predetermined shape on the entire surface of the sheet by the embossing roll 12. The object of this embossing is to enhance the strength, bulkiness, wiping property, etc. of the sheet and to improve the design.

[Finishing Step]

Next, the finishing step (S7) of the present embodiment will be described. In the finishing step (S7), as shown in FIG. 7, the following steps are performed as a series of events in the finish processing equipment 13: cutting of the embossed sheet 1E; folding of the respective cut sheets, impregnation with the aqueous agent (including a cross-linking agent, CNF, an aqueous detergent, a fragrance, an antiseptic, a disinfectant, a paper strengthening agent, organic solvent, etc.) to the respective folded sheets, and packaging of the respective sheets impregnated with the aqueous agent.

As a result of including CNF in the aqueous agent, CNF is accumulated on the surface of the embossed sheet 1E, and the wiping property of the toilet cleaning sheet obtained can be improved.

Through these steps, the toilet cleaning sheet is manufactured.

EXAMPLES

Next, the evaluation results of the wiping property are explained concerning Examples and Comparative Examples of the present invention.

<1. Sample Preparation>

First, the two-ply base paper sheet having weighing of 45 gsm in a dry state (Blend of pulp; NBKP:LBKP=40:60) was prepared.

Next, in the water-soluble binder application equipment, each aqueous solution was applied to the outer surface of each sheet with a spray.

Next, the sheet was dried until the moisture percentage reached about 8% by passing through a hot air dryer (temperature 180° C.) and slits were formed at a predetermined width. Abase sheet for processing the base paper sheet was thereby prepared.

Next, the dried base paper sheet was uniformly impregnated using a syringe with the chemical solutions (aqueous agents) of 200% by weight of the weight of the sheet prepared according to the following conditions of Examples 1 and 2 and Comparative Examples 1 to 3.

The blending ratios of the binder solution and the chemical solution of Example 1 and 2 and Comparative Examples 1 to 3 are described below.

Example 1

Binder solution: Water 96%, CMC (CMC 1330 (Daicel Corporation)) 4%

Chemical solution: Chemical solution 99.9996%, CNF 0.0004%

Example 2

Binder solution: Water 96%, CMC (CMC 1330 (Daicel Corporation)) 4%

Chemical solution: Chemical solution 99.9998%, CNF 0.0002%

Comparative Example 1

Binder solution: Water 96%, CMC (CMC 1330 (Daicel Corporation)) 4%

Chemical solution: Chemical solution 100%

Comparative Example 2

Binder solution: Water 96%, CMC (CMC 1330 (Daicel Corporation)) 2%, CNF 2%

Chemical solution: Chemical solution 100%

Comparative Example 3

Binder solution: Water 96%, CMC (CMC 1330 (Daicel Corporation)) 3.6%, CNF 0.4%

Chemical solution: Chemical solution 100%

CMC used here was CMC 1330 (Daicel Corporation).

CNF used here was CNF with 100% NBKP. CNF having an average fiber width (median diameter) of 49 nm was used. CNF was obtained by refiner treatment of NBKP for rough fibrillation, and treating it four times with a high pressure homogenizer for fibrillation.

CNF was added to the binder solution or the chemical solution as CNF dispersion solution.

Here, a method of measuring the fiber width (average fiber width) of CNF will be described.

First, 100 ml of an aqueous dispersion of cellulose nanofibers having a solid content concentration of 0.01 to 0.1 mass % is filtered with a Teflon (registered trademark) membrane filter, and the solvent is displaced once by 100 ml of ethanol and three times 20 ml by t-butanol.

Next, by freeze-drying and osmium-coating, a sample is obtained. This sample is observed in a SEM image by an electron microscope at a magnification of 5,000 times, 10,000 times, or 30,000 times (in the present embodiment, a magnification of 30,000 times) according to the width of the fibers constituting the sample. Specifically, two diagonal lines are drawn on the observed image, and arbitrarily three straight lines passing through the intersection of the diagonal lines are drawn. Further, the fiber width is visually measured from a total of 100 fibers which intersect with these three straight lines. Then, the median diameter of the measured values is taken as the average fiber diameter. The average fiber diameter is not limited to the median diameter of the measured value, but may be, for example, the number average diameter or the mode diameter (most frequent diameter).

The measurement results of the amount of CNF (gsm) on the sheet after processing in the samples of Examples 1 and 2 and Comparative Examples 1 to 3 are shown in Table I.

<2. Check of Wiping Property>

The property of wiping muddy feces was checked using the samples of Examples 1 and 2 and Comparative Examples 1 to 3.

The muddy feces here were artificial muddy feces with viscosity of 120 cPs.

In the test, after 1 mg of the muddy feces was dropped on a tile as a dirt and each of the samples of Examples 1 and 2 and Comparative Examples 1 to 3 were put on the dirt, a weight was put on the sample and pulled at a prescribed speed to wipe the muddy feces. Then, the amount of the remaining muddy feces was measured with Lumitester (Kikkoman Biochemifa Company: ATP method to measure ATP <adenosine triphosphate> (which is contained as energetic substance in all living things) as an indicator of dirt using luciferase, luminescent enzyme).

Table I shows the results.

TABLE I

| | Processing Conditions | | Amount of CNF on Sheet After Processing | CNF Weight to Sheet | Amount of Dirt After Wiping | Rate of Dirt |
|---|---|---|---|---|---|---|
| | Binder Solution | Chemical Agent | (gsm) | Weight (%) | (RLU) | Left (%) |
| Example 1 | No CNF | Blending Ratio of CNF 0.0004% | 0.00072 | 0.0008 | 16 | 53 |
| Example 2 | No CNF | Blending Ratio of CNF 0.0002% | 0.00036 | 0.0004 | 21 | 70 |
| Comparative Example 1 | No CNF | No CNF | 0 | 0 | 30 | 100 |
| Comparative Example 2 | Blending Ratio of CNF 2% | No CNF | 0.6 | 0.6667 | 16 | 53 |
| Comparative Example 3 | Blending Ratio of CNF 0.4% | No CNF | 0.12 | 0.1333 | 19 | 63 |

<Evaluation>

According to Table I, in the samples of Examples 1 and 2, the amount of the remaining muddy feces was smaller than in the sample of Comparative Example 1.

In the samples in Examples 1 and 2, the amount of CNF was smaller than in the samples in Comparative Examples 2 and 3, and the wiping property was all equal.

As described above, according to the present embodiment, a water-soluble binder solution into which CMC is blended is used and the cross-linking agent which cross-links the water-soluble binder, and CNF are blended into the aqueous agent. As a result, the wiping property can be improved without increase of the amount of CNF.

Although the present invention has been specifically described based on the embodiments, the present invention is not limited to the above-described embodiments, and modification can be made within a range not departing from the gist thereof.

For example, a cross-linking agent and CNF are blended into an aqueous agent in the embodiments of the present invention, but a CNF solution may be added to a sheet to which the aqueous agent containing a cross-linking agent is added after a solution containing a water-soluble binder is added to the sheet and the sheet is dried. Alternatively, an aqueous agent containing a cross-linking agent may be added after a CNF solution is added to the dried sheet.

For example, although a toilet cleaning sheet is described as an example of a hydrolytic sheet in the embodiments of the present invention, the present invention is not limited thereto, and can be applied to products that are desired to be able to be thrown away after use with a large amount of water in toilet etc., such as a body wiping sheet for wiping the body and a sheet for wiping ass.

In describing the embodiments and the like of the present invention, the emboss EM11 with a protrusion PR21 having a curved shape and the emboss EM12 with a protrusion PR22 having a planar shape are shown as an example, but the emboss is not necessarily limited to these shapes, but may have any shape.

For example, in describing the embodiments and the like of the present invention, all of the embosses EM11 and EM12 project toward the front side of the drawing in FIG. 1. However, the embosses EM11 and EM12 projecting toward the front direction of the drawing and the embosses EM11 and EM12 recessed toward the front direction of the drawing may be arranged alternately.

Figure 9:
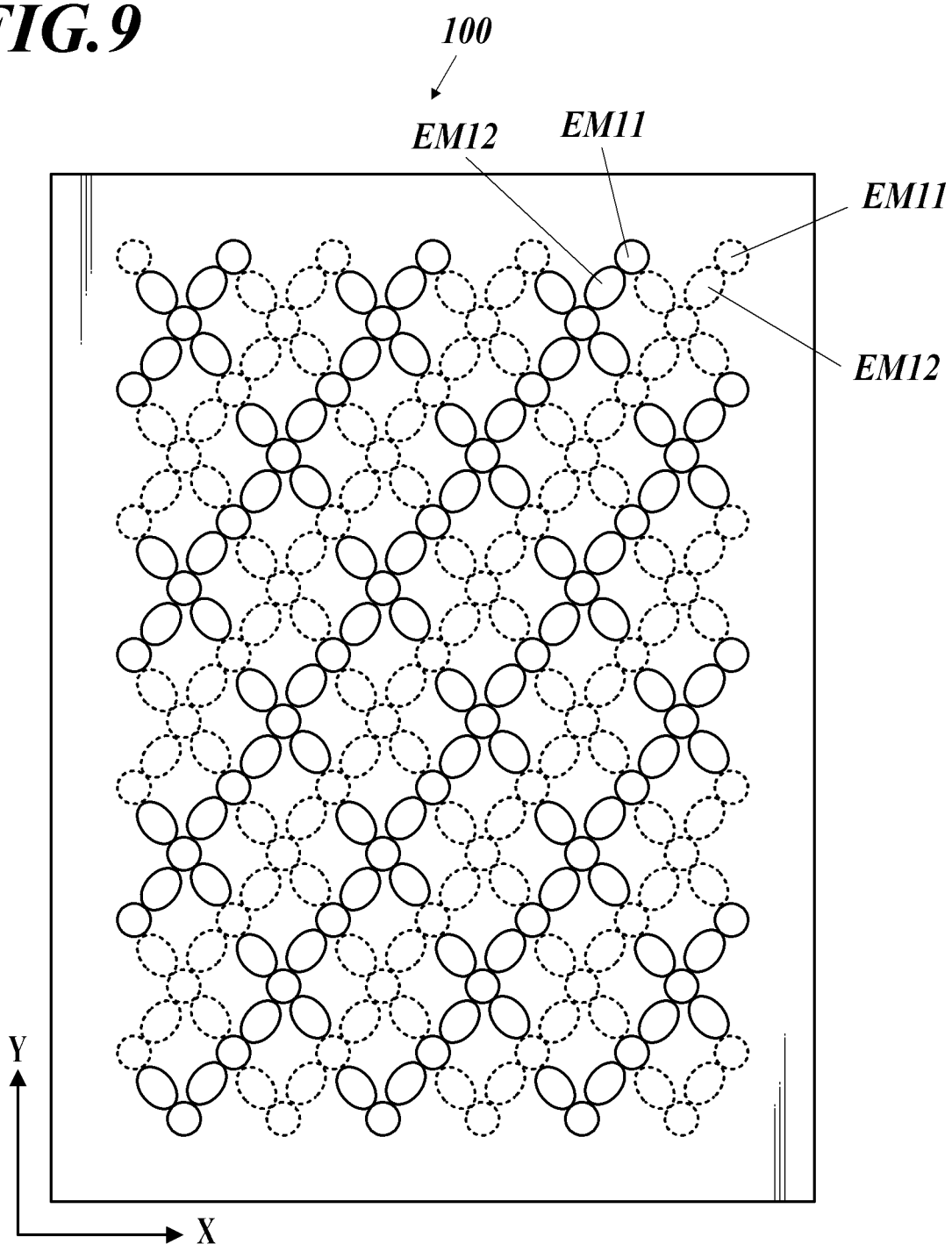
FIG. 9 is a plan view showing another example of the toilet cleaning sheet according to the present embodiment.

Specifically, as shown in FIG. 9, by alternately arranging the embosses EM11 and EM12 projecting toward the front direction of the drawing in FIG. 9 (solid line portions) and the embosses EM11 and EM12 recessed toward the front direction of the drawing in FIG. 9 (broken line portions), it is possible to improve the surface strength of the hydrolytic sheet and to provide a hydrolytic sheet with high wiping property on either side of the toilet cleaning sheet 101 by the embosses.

Figure 10:
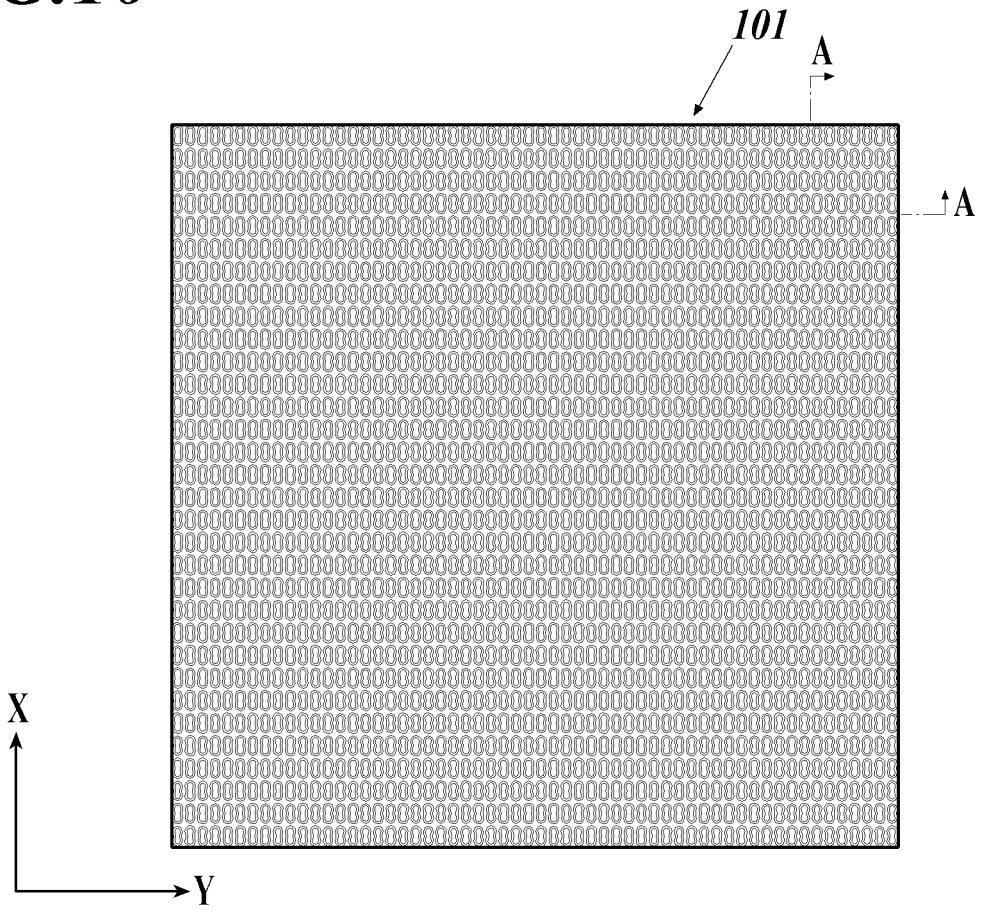
FIG. 10 is a plan view showing another example of the toilet cleaning sheet according to the present embodiment.
Figure 11:
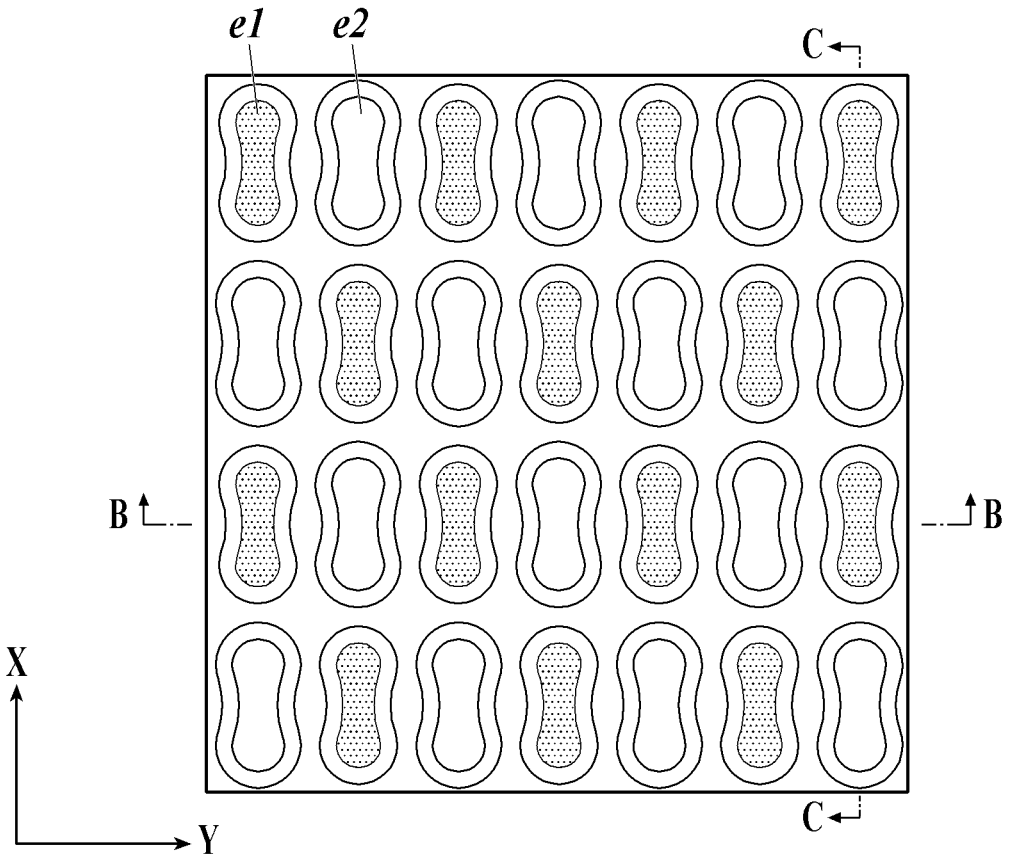
FIG. 11 is an enlarged view of a portion A-A in FIG. 10.
Figure 12A:
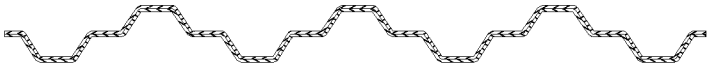
FIG. 12A is an end view of a cut-off portion taken along line B-B in FIG. 11.
Figure 12B:
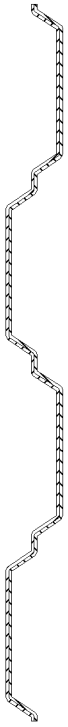
FIG. 12B is an end view of a cut-off portion taken along line C-C in FIG. 11.

FIGS. 10 to 12 show a modified example in which only the emboss pattern of the toilet cleaning sheet is different.

In FIGS. 10 to 12, the concave portion e2 has an inverted shape of the convex portion e1. The convex portion e1 and the concave portion e2 are alternately arranged in each of multiple rows. An emboss pattern is formed by arranging the multiple rows such that the convex portions e1 in adjacent rows are shifted from each other by a half pitch, and so are the concave portions e2. In this way, since the convex portions e1 and the concave portions e2 are alternately formed both in the length direction and the width direction, it is possible to improve the property of wiping stain compared with the emboss pattern in which the convex portions are arranged in a row or the concave portions are arranged in a row. The shapes of the convex portions e1 and the concave portions e2 are not particularly limited, and may be a circular shape, an elliptical shape, a polygonal shape, or the like. It may be a combination of the shapes.

In describing the embodiments and the like of the present invention, the water-soluble binder solution is applied with a spray, however, the binder solution may be applied to the continuous dry base paper 1A continuously drawn out from the first web roll 1 by a doctor chamber system (transfer equipment including two paired printing plate rolls with respect to one backup roll, anilox rolls paired with the respective printing plate rolls, and doctor chambers for applying the binder solution to the respective anilox rolls), and/or a three roll system (transfer equipment including two paired printing plate rolls with respect to one backup roll, anilox rolls paired with the respective printing plate rolls, dip rolls for applying the binder solution to the respective anilox rolls, and pans for applying the binder solution to the respective dip rolls). That is, in the solution adding step, from a printing machine(s) provided corresponding to at least one of the surfaces of the base paper serving as the front and back surfaces of the hydrolytic sheet, the binder solution may be transferred to the corresponding base paper.

INDUSTRIAL APPLICABILITY

The present invention is suitable for providing a hydrolytic sheet such as a toilet cleaning sheet which is impregnated with an aqueous agent in advance, and a method for manufacturing the hydrolytic sheet.

REFERENCE SIGNS LIST

100, 101 Toilet Cleaning Sheet
1 Primary Web Roll
1A Continuous Dry Base Paper
1B Ply Continuous Sheet
1C Continuous Sheet
1D Continuous Hydrolytic Sheet
1E Embossed Sheet
2 Overlapping Unit
3 Spray Nozzle
4 First Drying Equipment
5 Slitter
6 Winder Equipment
11 Secondary Web Roll
12 Embossing Roll
13 Finish Processing Equipment
14 Former
15 Wire
16 Suction Box
17 first Dry Part
18 Rotating Drum
19 Hood
20 Upper Conveyor Belt
21 Lower Conveyor Belt
22 Vacuum Roll
23 Spray Nozzle
24 Second Dry Part
25 Rotating Drum
26 Hood
EM11, EM12, EM21 Emboss
PR21, PR22 Protrusion
HT21, HT22 Height Of Protrusion
CN31, SN32 Contact Area
e1 Convex Portion
e2 Concave Portion

The invention claimed is:

1. A hydrolytic sheet comprising:
a base paper sheet impregnated with an aqueous agent, wherein:
the base paper sheet has a weight per unit area of 30 to 150 gsm and includes a water-soluble binder,
the aqueous agent includes a cross-linking agent which cross-links with the water-soluble binder,
the hydrolytic sheet comprises cellulose nanofiber, and an amount of the cellulose nanofiber accumulated on a surface of the base paper sheet is greater than an amount of the cellulose nanofiber at a center in a thickness direction in the base paper sheet.

2. The hydrolytic sheet according to claim 1, wherein the aqueous agent includes the cellulose nanofiber.

3. The hydrolytic sheet according to claim 1, wherein the water-soluble binder is carboxymethyl cellulose (CMC).

4. The hydrolytic sheet according to claim 3, wherein the cellulose nanofiber has a fiber width in a range of from 1 nm to 1000 nm.

5. The hydrolytic sheet according to claim 4, wherein the cross-linking agent is a polyvalent metal ion.

6. The hydrolytic sheet according to claim 1, wherein the cellulose nanofiber has a fiber width in a range of from 1 nm to 1000 nm.

* * * * *